US008047517B2

(12) United States Patent
Iacobelli et al.

(10) Patent No.: US 8,047,517 B2
(45) Date of Patent: Nov. 1, 2011

(54) VISE OR CLAMP ATTACHMENT

(76) Inventors: Michael D. Iacobelli, West Branch, MI (US); Ronald A. Iacobelli, Linden, MI (US)

( * ) Notice: Subject to any disclaimer, the term of this patent is extended or adjusted under 35 U.S.C. 154(b) by 460 days.

(21) Appl. No.: 12/154,240

(22) Filed: May 21, 2008

(65) Prior Publication Data

US 2008/0315480 A1 Dec. 25, 2008

Related U.S. Application Data

(60) Provisional application No. 60/936,566, filed on Jun. 21, 2007.

(51) Int. Cl.
*B25B 1/24* (2006.01)

(52) U.S. Cl. ..... 269/277; 269/163; 269/264

(58) Field of Classification Search ..... 269/277, 269/163, 264, 271, 266
See application file for complete search history.

(56) References Cited

U.S. PATENT DOCUMENTS

| | | | | | |
|---|---|---|---|---|---|
| 9,429 | A * | 11/1852 | Bliss | 269/262 |
| 170,344 | A * | 11/1875 | Caswell | 269/282 |
| 2,302,943 | A * | 11/1942 | Haselwood | 269/269 |
| 2,532,952 | A * | 12/1950 | Schmitt | 269/163 |
| 3,998,445 | A | 12/1976 | Goltz | |
| 4,240,621 | A | 12/1980 | Daddato | |
| 4,928,938 | A * | 5/1990 | Ross | 269/261 |
| 5,145,157 | A * | 9/1992 | Polk | 269/266 |
| 5,193,792 | A * | 3/1993 | Di Marco | 269/282 |
| 5,246,216 | A * | 9/1993 | Oberst | 269/266 |
| 5,931,453 | A | 8/1999 | Brennan | |
| 6,029,964 | A | 2/2000 | Bohl | |
| 6,431,534 | B1 * | 8/2002 | Orosz et al. | 269/43 |
| 2002/0109282 | A1 * | 8/2002 | Peck | 269/258 |
| 2008/0315480 | A1 * | 12/2008 | Iacobelli et al. | 269/277 |

* cited by examiner

*Primary Examiner* — George Nguyen
(74) *Attorney, Agent, or Firm* — Robert L. Farris; Farris Law, P.C.

(57) ABSTRACT

An attachment for use with a clamp having a pair of jaws operable to clamp a workpiece therebetween, such attachment comprising a body member of such size as to be accommodated in a space between one of the jaws and the workpiece. The body member of the attachment has a first contact surface adapted to bear against a surface of the workpiece and a second, opposite contact surface adapted to bear against one of the jaws. The second contact surface is so configured as to enable the attachment body member to be substantially universally rockable relative to the jaw engaged by such attachment body member, thereby enabling the body member to occupy a position in engagement with and substantially parallel to that surface of the workpiece engaged by the attachment body member.

18 Claims, 2 Drawing Sheets

VISE OR CLAMP ATTACHMENT

CROSS REFERENCE TO RELATED APPLICATIONS

This application claims the benefit of the filing date of U.S. Provisional Application No. 60/936,566, filed Jun. 21, 2007.

This invention related to an attachment for use with a clamp or vise having a pair of jaws operable to clamp a workpiece therebetween, the attachment having one surface adapted to bear against a workpiece accommodated between the jaws and a second surface bearing against one of the jaws, such attachment being substantially universally rockable relative to the jaw against which it bears so as to enable the workpiece engageable surface to conform to the confronting surface of the workpiece.

BACKGROUND OF THE INVENTION

A vise or clamp having jaws movable toward and away from one another commonly is used to clamp a workpiece while some operation is performed on such workpiece. Many workpieces are of irregular shape. Typical of such workpieces are tapered furniture legs, dowel rods, angled pieces of wood, and the like which do not lend themselves to secure clamping by the jaws. As a consequence, when an irregularly shaped or cylindrical workpiece occupies the space between the clamping jaws, the irregularity of the shape of such workpiece makes it difficult to apply clamping forces on the workpiece uniformly, thereby subjecting the workpiece to the possibility of damage due to an excessive concentration of clamping force on some part of the workpiece. If a workpiece is only partially engaged by the opposing jaws of a vise or clamp, the secure retention of the workpiece in place is jeopardized because the engaged surfaces of the workpiece and the clamp jaws may be of such small area as to enable slipping of the workpiece as operations are performed on the latter.

A principal object of the invention is to provide an attachment for use in clamping an irregularly shaped workpiece between movable jaws of a clamp or vise and in such manner as to overcome the objectionable characteristics referred to above.

SUMMARY OF THE INVENTION

An attachment constructed in accordance with the preferred embodiment of the invention comprises a body member that is adapted to be interposed between one jaw of a pair of jaws of a clamp or vise for engagement with a surface of a workpiece that also is engaged by the second jaw of the vise or clamp. The attachment has two surfaces, one of which is adapted to engage a workpiece and the other of which is adapted to bear upon one of the jaws of the clamp or vise. The workpiece engageable surface is substantially flat, but may have a concave groove therein for the accommodation of a cylindrical tube that either is of uniform diameter or tapers from one end toward the other. The jaw engaging surface of the attachment is spherical so as to enable the attachment to be substantially universally rockable relative to the jaw. Consequently, the attachment can assume any one of a number of different positions in which the workpiece engageable surface conforms to that of the workpiece, regardless of whether the workpiece surface is parallel or angled relative to the jaw against which the attachment bears.

THE DRAWINGS

THE PREFERRED EMBODIMENT

Apparatus constructed in accordance with the preferred embodiment of the invention is adapted for use with a clamp or vise V having two opposed jaws 1 and 2 which are movable toward and away from one another so as to provide a variable width space 3 therebetween, as is conventional.

Figure 1:
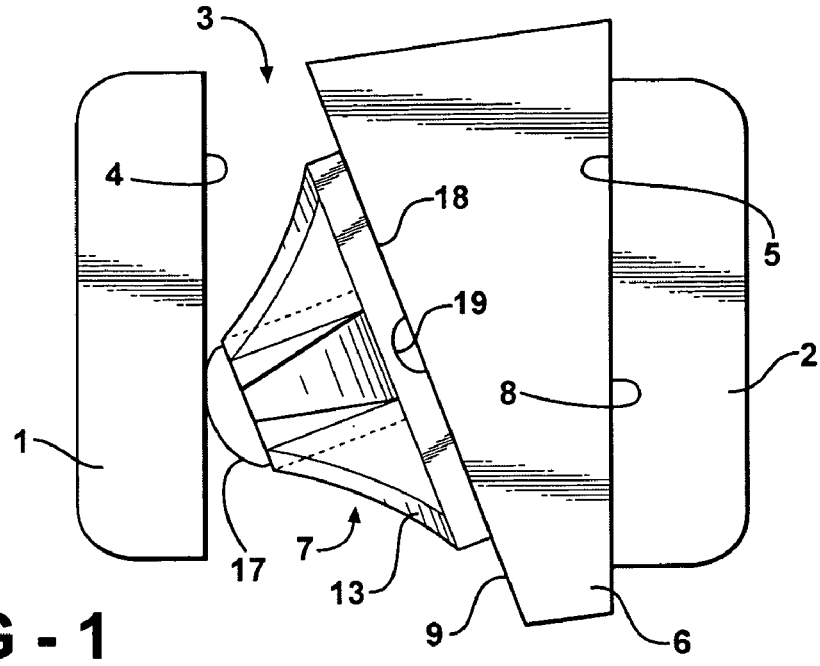
FIG. 1 is an end elevational view of a workpiece and an attachment constructed in accordance with the invention interposed between and in engagement with two opposed vise or clamp jaws.
Figure 2:
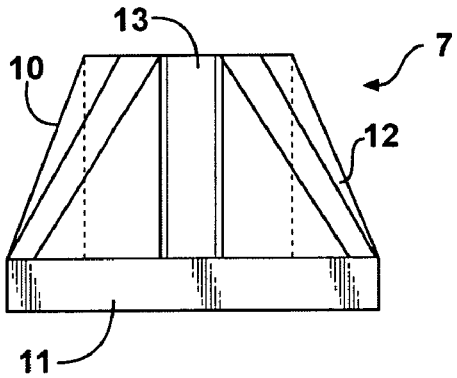
FIG. 2 is an end elevational view of the attachment.
Figure 3:
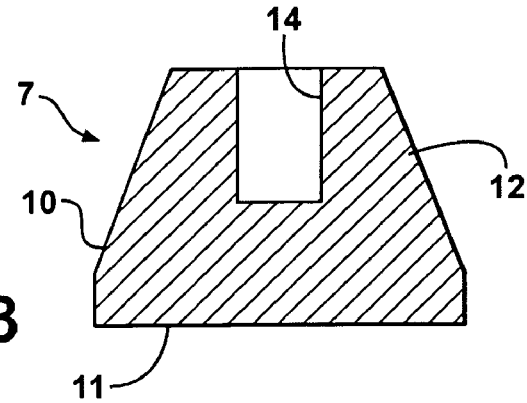
FIG. 3 is a vertical sectional view of the attachment.
Figure 4:
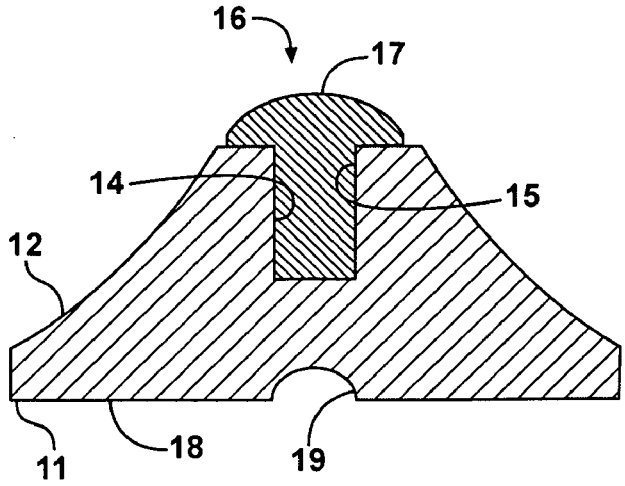
FIG. 4 is a vertical sectional view through the attachment within which is a jaw-engaging member.
Figure 5:
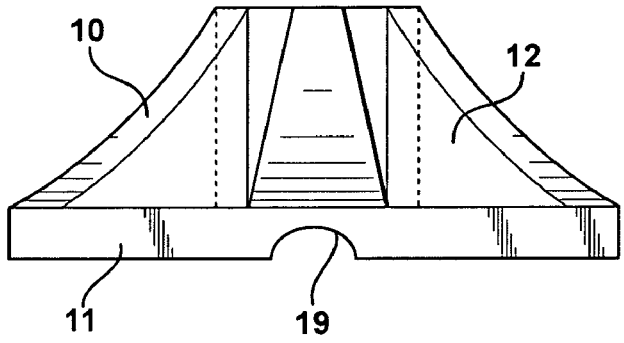
FIG. 5 is an end elevational view similar to FIG. 4, but omitting the jaw-engaging member.
Figure 6:
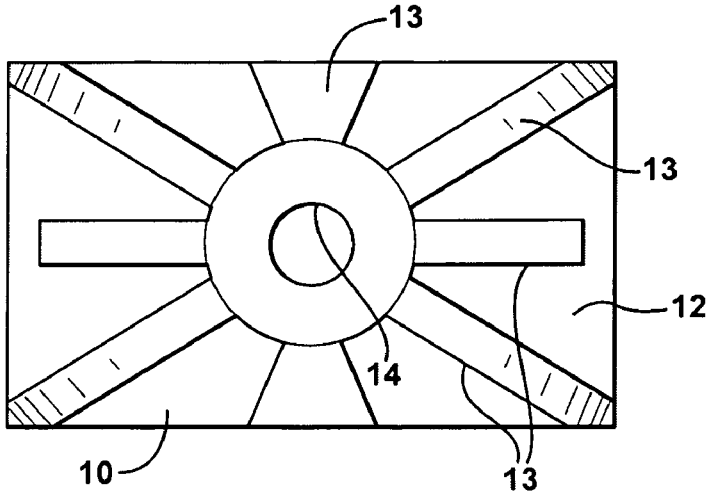
FIG. 6 is a top plan view of the attachment, but omitting the jaw-engaging member.

The jaw 1 has a substantially flat, linear surface 4 and the jaw 2 has a corresponding surface 5 which confronts the surface 4. As is shown in FIG. 1, a workpiece 6 and an attachment 7 according to the invention are interposed between the surfaces 4 and 5 of the jaws 1 and 2. As shown, the workpiece 6 tapers from one end toward the other and has a substantially flat surface 8 which bears on the jaw surface 5 and an opposite surface 9 which does not parallel the surface 8, but instead extends at an angle thereto so that the workpiece tapers from one end toward the other.

The attachment 7 comprises a body 10 of truncated conical configuration in side and end elevation and has a flat base 11 from which extends an upwardly tapering main section 12. A plurality of ribs 13 extend upwardly from the base for reinforcing the body section 12.

At the smaller area end of the section 12 is a bore 14 in which is accommodated the stem 15 of a dome-like contact member or insert 16 having an enlarged, spherical contact surface 17. Preferably, the stem 15 has an interference fit in the bore 14 so as to avoid inadvertent separation of the member 16 from the body 10. Alternatively, the stem and the bore may be correspondingly threaded.

The base 11 has a contact surface 18 which may be planar, if desired, but preferably has an arcuate groove 19 extending the full length thereof. The groove enables a cylindrical tube to be accommodated in the groove in such manner that the groove surface provides a large area of engagement between the attachment and the tube. The arrangement minimizes the possibility of crushing the tube by a concentration of force. Rather than providing an arcuate groove, the groove could be formed by a notch having two right angular surfaces. In either case, however, the groove is concave.

To condition the attachment 7 for use, the jaws 1 and 2 are moved apart a distance sufficient to accommodate both the workpiece 6 and the attachment 7 therebetween. The workpiece 6 is so arranged that its surface 8 confronts and bears against the surface 5 of the jaw 2. The attachment 7 is so arranged that its planar surface 18 confronts and bears against the surface 9 of the workpiece. The spherical contact surface 17 of the attachment 7 is arranged in such manner that it confronts and bears upon the surface 4 of the jaw 1. As will be apparent from FIG. 1, the attachment 7 is substantially universally rockable about the point of engagement of the surfaces 4 and 17, thereby enabling the surface 18 of the attachment to be substantially flush with the surface 9 of the workpiece 6. The extent of taper of the workpiece 6 is exaggerated n FIG. 1 to illustrate the wide range of adjustment of which the attachment is capable.

Preferably, the configuration of the attachment body is such as to enable the attachment to rock through substantially 180° about the fulcrum formed by the spherical surface 17. The attachment thus is capable of use with a large variety of irregularly shaped workpieces.

The disclosed embodiment is representative of a presently preferred form of the invention, but is intended to be illustrative rather than definitive thereof. The invention is defined in the claims.

We claim:

1. An attachment for use with a clamp having a pair of jaws operable to clamp a workpiece therebetween, said attachment comprising a body member of such size as to be accommodated in a space between one of said jaws and said workpiece, said body member having a first contact surface adapted to bear against a surface of said workpiece and a second, contact surface adapted to bear against said one of said jaws, said second contact surface being so configured as to enable said body member to be substantially universally rockable relative to said one of said jaws when said body member is accommodated in said space and said second contact surface bears against said one of said jaws, thereby enabling said first contact surface to occupy a position in engagement with and substantially parallel to said surface of said workpiece; and wherein said second contact surface is formed by an insert accommodated in a recess in said body member.

2. The attachment according to claim 1 wherein said second contact surface is spherical.

3. The attachment according to claim 1 wherein said first contact surface of said body member is substantially planar.

4. The attachment according to claim 1 wherein said first contact surface has a continuous groove therein.

5. The attachment according to claim 4 wherein said groove is arcuate.

6. The attachment according to claim 1 wherein said body member is substantially conical in side and end elevation.

7. An attachment for use with a clamp having a pair of jaws operable to clamp a workpiece therebetween, said attachment comprising a body member of such size as to be accommodated in a space between one of said jaws and said workpiece, said body member having a first contact surface adapted to bear against a surface of said workpiece and a second, contact surface adapted to bear against said one of said jaws, said second contact surface being so configured as to enable said body member to be substantially universally rockable relative to said one of said jaws when said body member is accommodated in said space and said second contact surface bears against said one of said jaws, thereby enabling said first contact surface to occupy a position in engagement with and substantially parallel to said surface of said workpiece; and wherein said second contact surface is formed by an insert accommodated in a recess in said body member; and wherein said body member has sides at least some of which taper in a direction toward said second contact surface.

8. An attachment for use with a clamp having a pair of jaws operable to clamp a workpiece therebetween, said attachment comprising a body member of such size as to be accommodated in a space between one of said jaws and said workpiece, said body member having a first contact surface adapted to bear against a surface of said workpiece and a second, contact surface adapted to bear against said one of said jaws, said second contact surface being so configured as to enable said body member to be substantially universally rockable relative to said one of said jaws when said body member is accommodated in said space and said second contact surface bears against said one of said jaws, thereby enabling said first contact surface to occupy a position in engagement with and substantially parallel to said surface of said workpiece; and wherein said second contact surface is formed by a dome-like enlargement at one end of a stem, said stem being accommodated in an opening in said body member.

9. The attachment according to claim 8 wherein said stem has an interference fit in said opening.

10. In combination, a vise or clamp having first and second spaced apart, confronting jaws movable toward and away from one another; a workpiece between said jaws; a body member between one of said jaws and a first surface of said workpiece, said workpiece having a second surface bearing against the other of said jaws, said body member having a contact surface bearing against said one of said jaws and forming a fulcrum about which said body member is rockable, said body member having a workpiece engageable surface bearing against another surface of said workpiece, said contact surface enabling said body to be substantially universally rockable about said fulcrum relative to said one of said jaws, thereby enabling said workpiece engageable surface to occupy a position substantially parallel to said another surface of said workpiece; and wherein said contact surface is formed by an insert accommodated in a recess in said body member.

11. The attachment according to claim 10 wherein said contact surface is spherical.

12. The attachment according to claim 10 wherein workpiece engageable surface of said body member is substantially planar.

13. The combination according to claim 10 wherein said workpiece engageable surface has a continuous groove therein.

14. The combination according to claim 13 wherein said groove is arcuate.

15. The combination according to claim 10 wherein said body member is substantially conical in side and end elevation.

16. In combination, a vise or clamp having first and second spaced apart, confronting jaws movable toward and away from one another; a workpiece between said jaws; and a body member between one of said jaws and a first surface of said workpiece, said workpiece having a second surface bearing against the other of said jaws, said body member having a contact surface bearing against said one of said jaws and forming a fulcrum about which said body member is rockable, said body member having a workpiece engageable surface bearing against another surface of said workpiece, said contact surface enabling said body to be substantially universally rockable about said fulcrum relative to said one of said jaws, thereby enabling said workpiece engageable surface to occupy a position substantially parallel to said another surface of said workpiece; wherein said body member is substantially conical in side and end elevation; and, wherein said body member has sides at least some of which taper in a direction toward said contact surface.

17. In combination, a vise or clamp having first and second spaced apart, confronting jaws movable toward and away from one another; a workpiece between said jaws; a body member between one of said jaws and a first surface of said workpiece, said workpiece having a second surface bearing against the other of said jaws, said body member having a contact surface bearing against said one of said jaws and forming a fulcrum about which said body member is rockable, said body member having a workpiece engageable surface bearing against another surface of said workpiece, said contact surface enabling said body to be substantially universally rockable about said fulcrum relative to said one of said jaws, thereby enabling said workpiece engageable surface to occupy a position substantially parallel to said another surface of said workpiece; and wherein said contact surface is formed by a dome-like enlargement at one end of a stem, said stem being accommodated in an opening in said body member.

18. The combination according to claim 10 wherein said body member is rockable about said contact surface through substantially 180°.

* * * * *